US006729621B2

(12) United States Patent
Moody

(10) Patent No.: US 6,729,621 B2
(45) Date of Patent: May 4, 2004

(54) VIDEO POKER GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/379,158

(22) Filed: Mar. 3, 2003

(65) Prior Publication Data

US 2003/0164590 A1 Sep. 4, 2003

Related U.S. Application Data

(60) Provisional application No. 60/361,784, filed on Mar. 4, 2002.

(51) Int. Cl.[7] ..... A63F 1/00

(52) U.S. Cl. ..... 273/292; 273/274; 273/309; 463/12; 463/13; 463/16

(58) Field of Search ..... 273/292, 274, 273/309; 463/12, 13, 16

(56) References Cited

U.S. PATENT DOCUMENTS 5,732,950 A * 3/1998 Moody ..... 273/292
5,755,621 A * 5/1998 Marks et al. ..... 463/42
5,823,873 A * 10/1998 Moody ..... 463/13
5,853,325 A * 12/1998 Kadlic ..... 463/13
5,897,436 A * 4/1999 Singer et al. ..... 273/293
6,007,066 A * 12/1999 Moody ..... 273/292
6,093,100 A * 7/2000 Singer et al. ..... 463/13
6,419,578 B1 * 7/2002 Moody et al. ..... 463/13
6,517,074 B1 * 2/2003 Moody et al. ..... 273/292
6,537,150 B1 * 3/2003 Luciano et al. ..... 463/16
6,568,680 B1 * 5/2003 Moody et al. ..... 273/292
6,652,377 B1 * 11/2003 Moody ..... 463/13

* cited by examiner

*Primary Examiner*—Benjamin H. Layno
*Assistant Examiner*—Dolores R. Collins
(74) *Attorney, Agent, or Firm*—John Edward Roethel

(57) ABSTRACT

Whenever the player achieves one of the predetermined types of starting hand combinations on the initial deal of a hand of video poker, then the player is provided with the opportunity to split his starting hand into two or more hands without having to make an additional wager. After the player has split his original starting hand, additional cards are dealt from the remaining cards to complete five cards hands. Each of the final five card hands are analyzed to determine the poker hand ranking. The player receives an award for each hand that has a winning poker hand ranking and the amount of the award is based on a pay table and the amount wagered by the player. Each of the final hands are considered as having the full amount wagered by the player.

10 Claims, 7 Drawing Sheets

VIDEO POKER GAMES

CROSS-REFERENCE TO RELATED APPLICATION

This application is based on and claims priority of Provisional Application Ser. No. 60/361,784, filed Mar. 4, 2002, entitled "Video Poker Games."

This invention relates primarily to video poker games, and more particularly to video poker games that are programmed to play on an electronic video poker machine. Based on achieving certain starting hand combinations, the player has the option to split the hand into one or more additional hands without having to make an additional wager.

BACKGROUND OF THE INVENTION

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard fifty-two card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand.

In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are reused from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager.

It is an object of the present invention to provide a new form of an electronic video poker game that provides the player with the ability to split his original poker hand into two or more additional video poker hands without having to increase his wager.

It is a feature of the present invention that whenever the player achieves one of the predetermined types of starting hand combinations on the initial deal of a hand of video poker, then the player is provided with the opportunity to split his starting hand into two or more hands without having to make an additional wager. The types of starting hands that the player would be allowed to split are Pair of Jacks, Queens, Kings or Aces; Two Pair; Three-of-a-Kind; and a Full House.

It is a further feature of the present invention that the player is given the option of splitting his hand after the draw step has occurred. In such a case, the player may only receive an award if one or more of the split hands improves in poker hand ranking.

It is an advantage of the present invention that the player is provided with one or more additional hands of video poker to play without having to make another wager. This increases the player's opportunity to achieve winning payouts without significantly increasing the monetary risk to the player.

Other objects, features and advantages of the present invention will become apparent from a consideration of the following detailed description.

SUMMARY OF THE INVENTION

The first version of the present invention begins with the player playing a conventional hand of video poker. Whenever the player achieves one of the predetermined types of starting hand combinations on the initial deal of the hand of video poker, then the player is provided with the opportunity to split his starting hand into two or more hands without having to make an additional wager. The types of starting hands that the player would be allowed to split are a Pair of Jacks, Queens, Kings or Aces; Two Pair; Three-of-a-Kind and a Full House.

After the player has split his original starting hand, additional cards are dealt from the remaining cards to complete five cards hands. Each of the final five card hands are analyzed to determine the poker hand ranking. The player receives an award for each hand that has a winning poker hand ranking and the amount of the award is based on a pay table and the amount wagered by the player. Each of the final hands are considered as having the full amount wagered by the player.

A second version of the present invention involves giving the player the option of splitting his single original hand after the draw step has occurred. In this version, the player may only receive an award if one or more of the split hands improves in poker hand ranking.

DETAILED DESCRIPTION Of THE PREFERRED EMBODIMENTS

Figure 1:
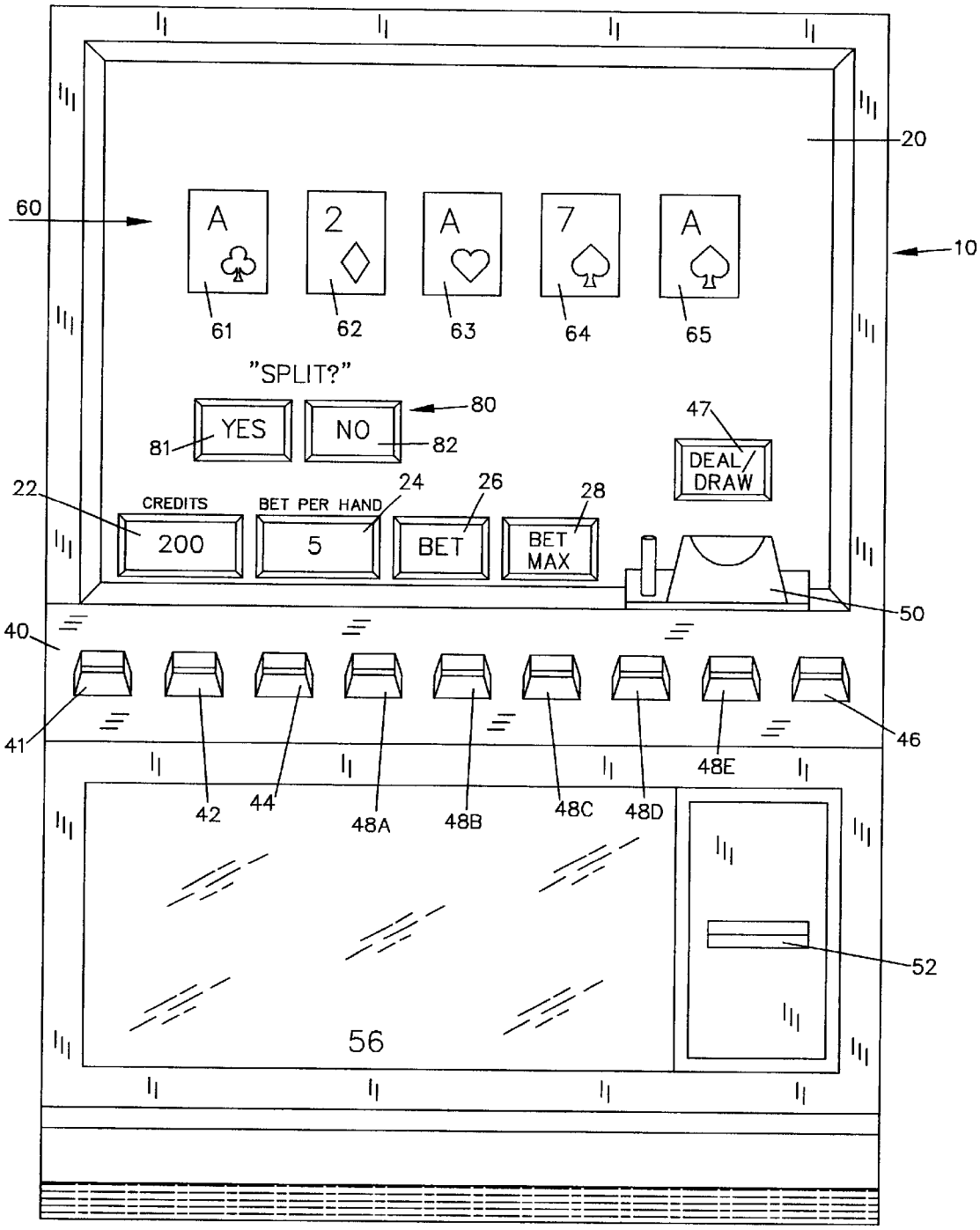
FIG. 1 shows a representative electronic video gaming machine of the present invention including a typical screen display used in the method of play of version #1 of the present invention after the initial deal of the cards.

The method of the present invention can be applied to any poker format used for video poker. FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. As shown in FIG. 1, a first hand: HAND ONE 60 is shown. Each hand would preferably have five card locations preferably from left to right in a horizontal row, although other manners of displaying single or multiple hands can be used. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens or paper currency to add a sufficient amount of credits on the credit display meter 22, the player makes his initial wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above.

VERSION #1

This version of the present invention is played similar to conventional video draw poker, except that the player is provided with the option of splitting his starting hand into one or more additional hands if the starting hand is one of a predetermined group of starting hands. In the preferred embodiment of the present invention, the predetermined starting hands that would allow the player to split his starting hand are a Pair of Jacks, Queens, Kings or Aces; Two Pair; Three-of-a-Kind and a Full House.

The method of play of the present invention can be played with any suitable video draw poker format such as Draw Poker, Bonus Poker, Double Bonus Poker, Double Double Bonus Poker, Triple Bonus Poker, Super Bonus Poker and the like. Each of these poker format would use a standard deck of fifty-two playing cards. It is also possible to play the method of the present invention in draw poker formats that include wild cards such as Deuces Wild, One-Eyed Jacks Wild and the like. Additional wild cards, such as one or more Jokers, may be added to the conventional fifty-two card deck to allow the method of the present invention to be played in poker formats such as Jokers Wild, Deuces Joker Wild and the like.

The player makes a wager to participate in the method of play. A starting five card hand 60 shown in FIG. 1, is dealt to the player. In the example shown in FIG. 1, the starting five card hand 60 dealt to the player comprises the Ace of Clubs 61, the Two of Diamonds 62, the Ace of Hearts 63, the Seven of Spades 64 and the Ace of Spades 65.

Because the starting hand 60 comprises a Three-of-a-Kind, the player has the option of splitting this hand into two separate hands—one of the hands being the Three-of-a-Kind and the other hand being the two other cards. Any suitable message can be displayed on the video screen 20 to alert the player to this option of splitting his starting first hand 60. For example, as shown in FIG. 1, the electronic controls of gaming machine 10 can cause a "SPLIT?" message 80 to appear on the video screen 20. The player may elect to split by pressing the YES screen location 81 or the player may decline to split by pressing the NO screen location 82. Alternatively or additionally, selected buttons on the button panel 40 can be illuminated to allow the player to make his YES or NO split section by pressing one of the buttons.

If the player presses the NO screen location 82 and does not wish to split his starting first hand 60, the starting hand 60 is played out according to the conventional manner of play of video draw poker. The player decides which cards he wishes to hold from the starting hand 60. After the player has made the selection of which cards the player wishes to hold, if any, replacement cards are displayed for the discarded cards in the starting hand 60 and replacement cards are displayed for the discarded cards in the second hand as is conventional in video poker. The replacement cards for the discarded cards from the starting hand 60 are dealt from the remaining forty-seven card deck which comprises the original fifty-two card deck minus the five originally dealt cards as is conventional in video poker. The final five card hand is analyzed to determine the poker hand ranking of the final five card hand. Depending on the poker hand ranking of the final five card hand, the player wins or loses according to the pay table being used again as is conventional in video poker.

Figure 2:
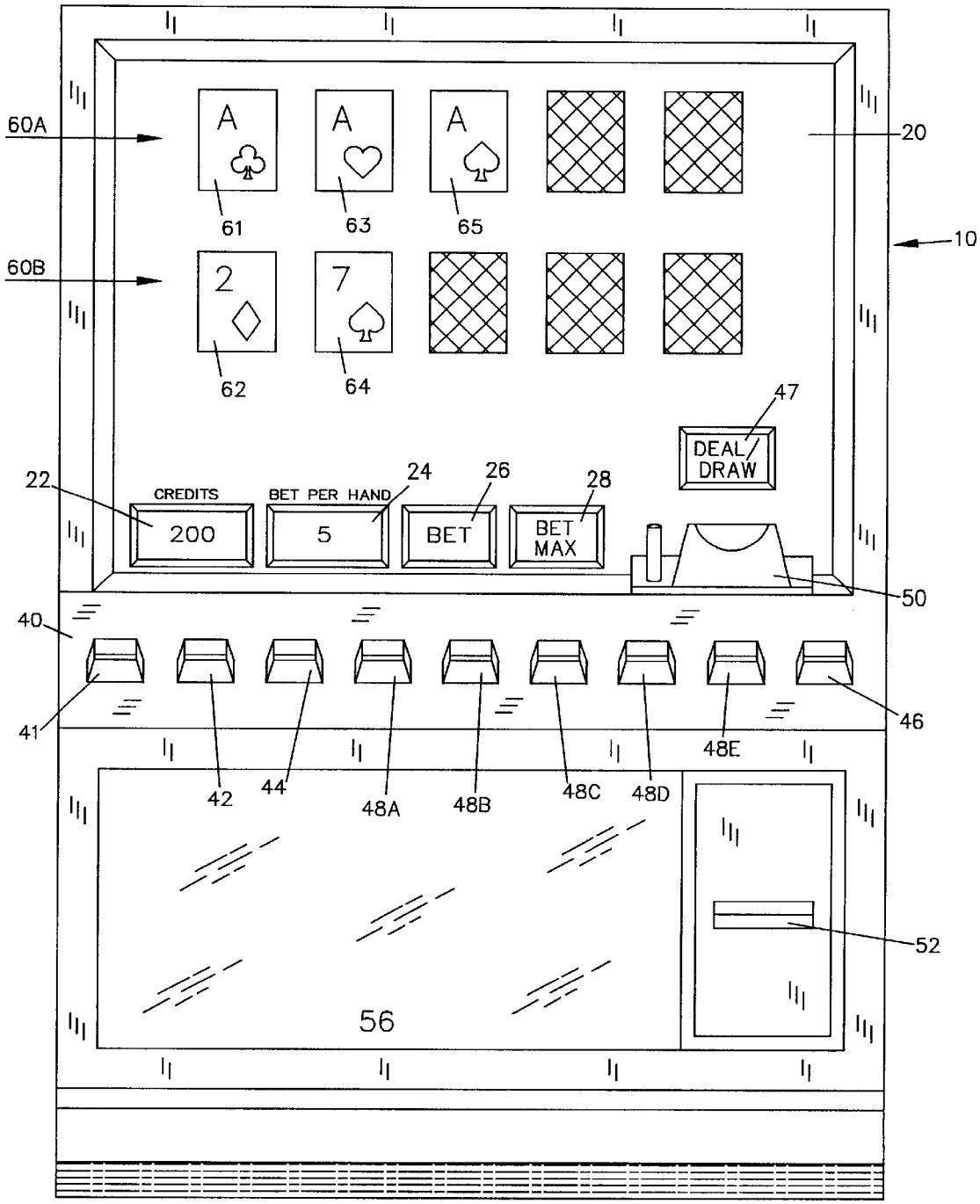
FIG. 2 shows a representative electronic video gaming machine of the present invention including a typical screen display used in the method of play of version #1 of the present invention after the player has elected to split his starting hand.

If the player presses the YES screen location 81 and does wish to split his starting first hand 60, the starting first hand 60 is split into two partial hands 60A and 60B as shown in FIG. 2. For example, a starting hand 60 of Three-of-a-Kind is split into just the Three-of-a-Kind first hand 60A (the Ace of Clubs 61, the Ace of Hearts 63 and the Ace of Spades 65) and the two remaining cards second hand 60B (the Two of Diamonds 62 and the Seven of Spades 64). Even though the player has only made a single wager such as five credits at the beginning of the round of play, each hand is played for a value of the amount of the player's single wager, i.e. the first hand 60A is played for a value of five credits and the second hand 60B is played for a value of five credits.

After the starting hand has been split into two hands, additional cards are dealt from the original deck into each of the two hands to complete each hand to a five card final hand.

Figure 3:
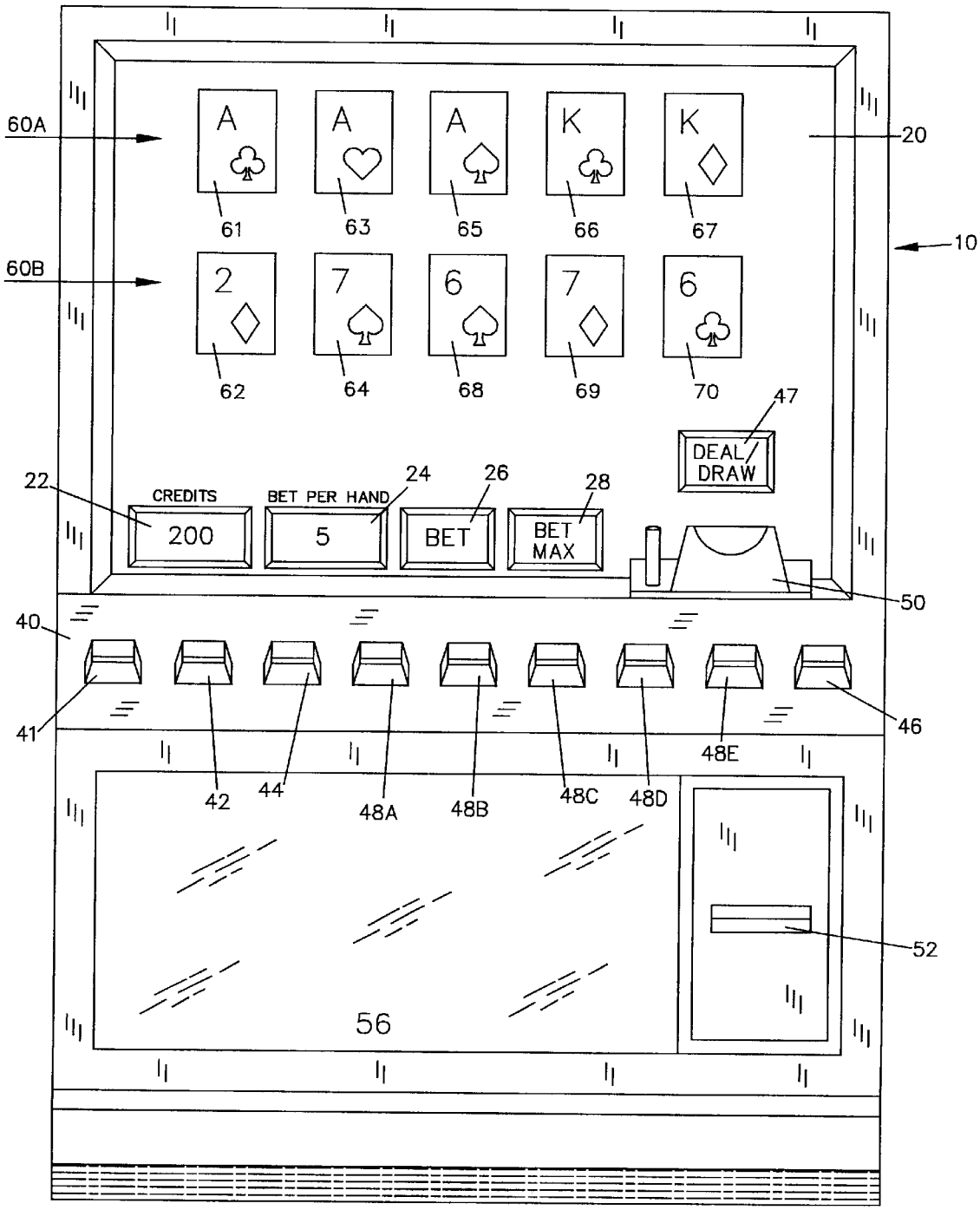
FIG. 3 shows a representative electronic video gaming machine of the present invention including a typical screen display used in the method of play of version #1 of the present invention after the additional cards have been dealt to each of the split hands.
Figure 4:
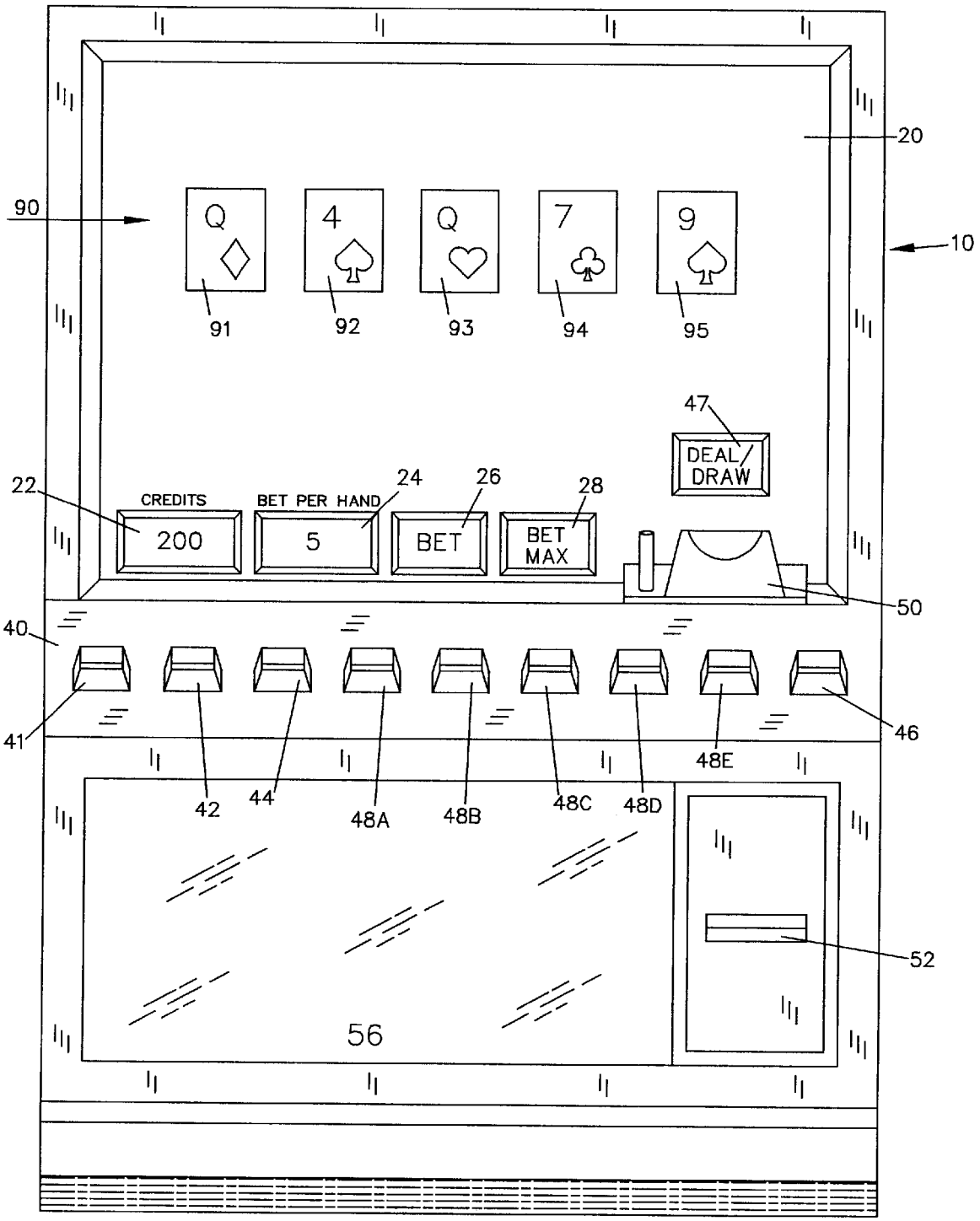
FIG. 4 shows a representative electronic video gaming machine of the present invention including a typical screen display used in the method of play of version #2 of the present invention after the initial deal of the cards.

As shown in the example in FIG. 3, first hand 60A receives two more cards—the King of Clubs 66 and the King of Diamonds 67. The final five card first hand 60A has a poker hand ranking of a Full House.

Also as shown in the example in FIG. 3, second hand 60B receives three more cards—the Six of Spades 68, the Seven of Diamonds 69 and the Six of Clubs 70. The final five card second hand 60B has a poker hand ranking of a Two Pair.

Any suitable pay table may be used and would be associated with the poker format being used by the player. For example, a suitable poker format for the method of the present invention is Double Double Bonus Poker. A suitable pay table for Double Double Bonus Poker played in accordance with Version #1 of the method of play of the present invention is shown in Table 1:

TABLE 1

| DOUBLE DOUBLE BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STPAIGHT FLUSH | 50 | 100 | 150 | 200 | 250 |
| FOUR ACES WITH 2, 3 OR 4 | 400 | 800 | 1200 | 1600 | 2000 |
| FOUR ACES | 160 | 320 | 480 | 640 | 800 |
| FOUR 2'S, 3'S OR 4'S WITH ACE, 2, 3 OR 4 | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The numerical amount shown in each cell corresponds to the number of credits won by the player based on the amount wagered on the hand.

Referring to the example shown in FIG. 3, the player would be awarded forty credits for achieving a Full House on the first hand 60A and the player would be awarded five credits for achieving a Two Pair on the second hand 60B.

Although it is theoretically possible to allow the player to split any starting hand, in the preferred embodiment of the present invention as noted above, the player would only be allowed to split a starting hand that had a Pair of Jacks, Queens, Kings or Aces; Two Pair; Three-of-a-Kind and a Full House.

If the starting hand is a Pair of Jacks, Queens, Kings or Aces, this hand would split into two hands—the first hand having the Pair of Jacks, Queens, Kings or Aces and the second hand having the three remaining cards. For example, a starting hand of a Pair of Jacks and three other cards (none of which are a Pair or Three-of-a-Kind) would be split into a first hand of the two Jacks and a second hand of the three remaining cards. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager.

If the starting hand is Two Pair, this hand would split into three hands—the first hand having a single pair, the second hand having a single pair and the third hand having the remaining one card. For example, a starting hand of two Sixes, two Jacks and an Ace would be split into a first hand of two Sixes, a second hand of two Jacks and a third hand of the Ace. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager.

If the starting hand is Three-of-a-Kind (as shown in the above example), this hand would split into two hands—the first hand having the Three-of-a-Kind and the second hand having the remaining two cards. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager.

If the starting hand is a Full House, this hand would split into two hands—the first hand having a Three-of-a-Kind and the second hand having a Pair. For example, a starting hand of three Sixes and two Jacks would be split into a first hand of three Sixes and a second hand of two Jacks. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager.

VERSION #2

This version of the present invention is played similar to conventional video draw poker, except that the player is provided with the option of splitting his ending hand into one or more additional hands if the ending hand is one of a predetermined group of starting hands. In the preferred embodiment of the present invention, the predetermined starting hands that would allow the player to split his starting hand are a Two Pair, a Three-of-a-Kind and a Full House. In the preferred embodiment of this version of the present invention, the player would only receive an award for a final hand that improved over the ending hand being split, i.e. a final hand would have to have a higher poker hand ranking than the ending hand that was split.

The player makes a wager to participate in the method of play of this version #2. A starting five card hand 90 shown in FIG. 1, is dealt to the player. In the example shown in FIG. 1, the starting five card hand 90 dealt to the player comprises the Queen of Diamonds 91, the Four of Spades 92, the Queen of Hearts 93, the Seven of Clubs 94 and the Nine of Spades 95.

Figure 5:
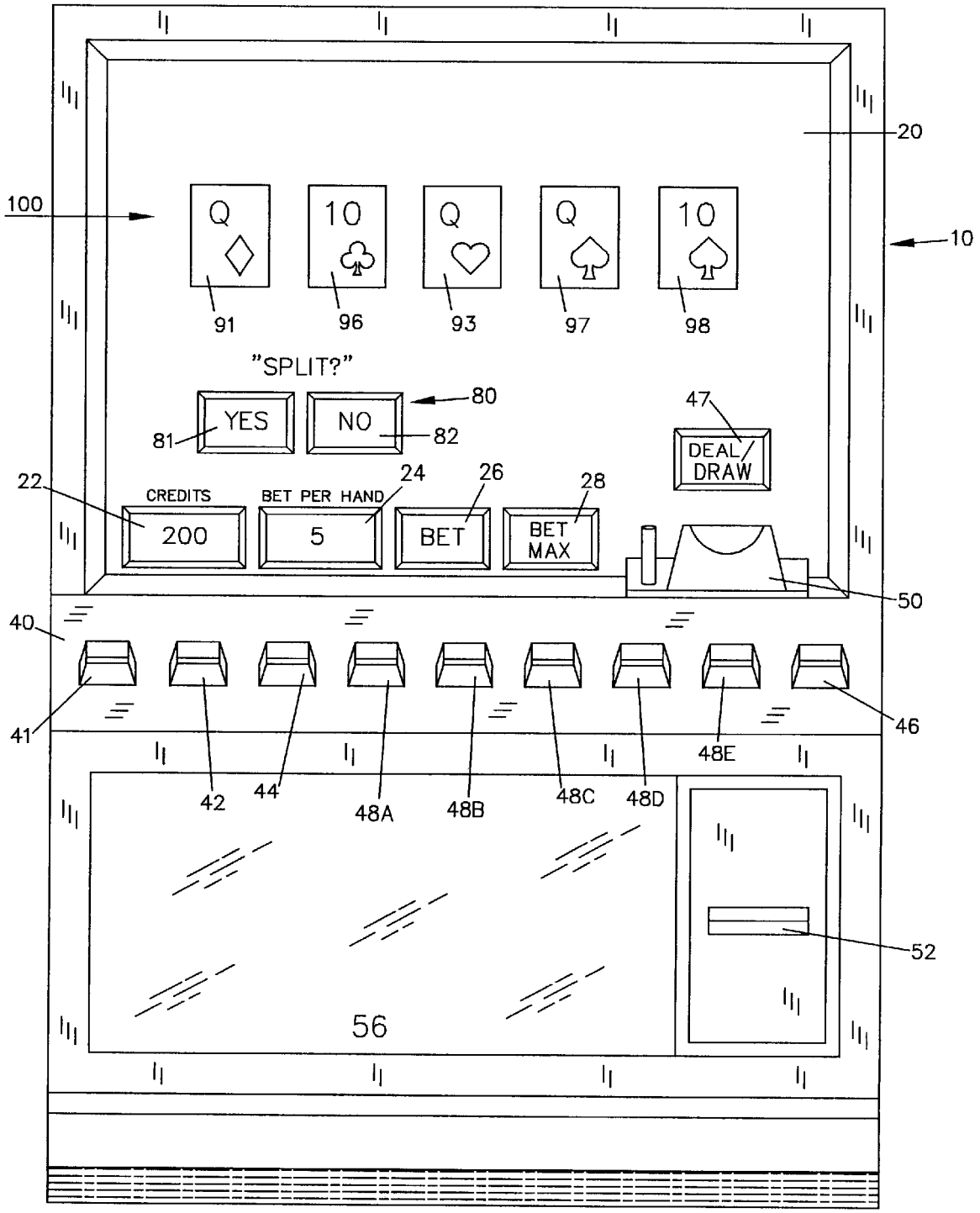
FIG. 5 shows a representative electronic video gaming machine of the present invention including a typical screen display used in the method of play of version #2 of the present invention after the draw step and the dealing of replacement cards.

The starting hand 90 is played out according to the conventional manner of play of video draw poker. The player decides which cards he wishes to hold from the starting hand 90. If the player were to use conventional video draw poker strategy for a Double Double Bonus poker format game, the player would hold the Pair of Queens and discard the other three cards. After the player has made the selection of which cards the player wishes to hold, if any, replacement cards are displayed for the discarded cards in the starting hand 90 and replacement cards are displayed for the discarded cards in the ending hand 100 as shown in FIG. 5.

The replacement cards for the discarded cards from the starting hand 90 are dealt from the remaining forty-seven card deck which comprises the original fifty-two card deck minus the five originally dealt cards as is conventional in video poker. The final five card hand is analyzed to determine the poker hand ranking of the final five card hand. Depending on the poker hand ranking of the final five card hand, the player wins or loses according to the pay table being used again as is conventional in video poker. As shown in the example in FIG. 5, the replacement cards are a Ten of Clubs 96, a Queen of Spades 97 and a Ten of Spaces 98. The ending hand 100 has a poker hand ranking of a Full House.

Because the ending hand 100 comprises a Full House, the player has the option of splitting this hand into two separate hands—one of the hands being the three Queens and the other hand being the two Tens. Any suitable message can be displayed on the video screen 20 to alert the player to this option of splitting his ending hand 100. For example, as shown in FIG. 5, the electronic controls of gaming machine 10 can cause a "SPLIT?" message 80 to appear on the video screen 20. The player may elect to split by pressing the YES screen location 81 or the player may decline to split by pressing the NO screen location 82. Alternatively or additionally, selected buttons on the button panel 40 can be illuminated to allow the player to make his YES or NO split section by pressing one of the buttons.

If the player presses the NO screen location 82 and does not wish to split his ending hand 100, the player wins an award according to the pay table being used as is conventional in video poker. In this example, assuming the player's wager was five credits, the player would be awarded forty credits for the Full House.

Figure 6:
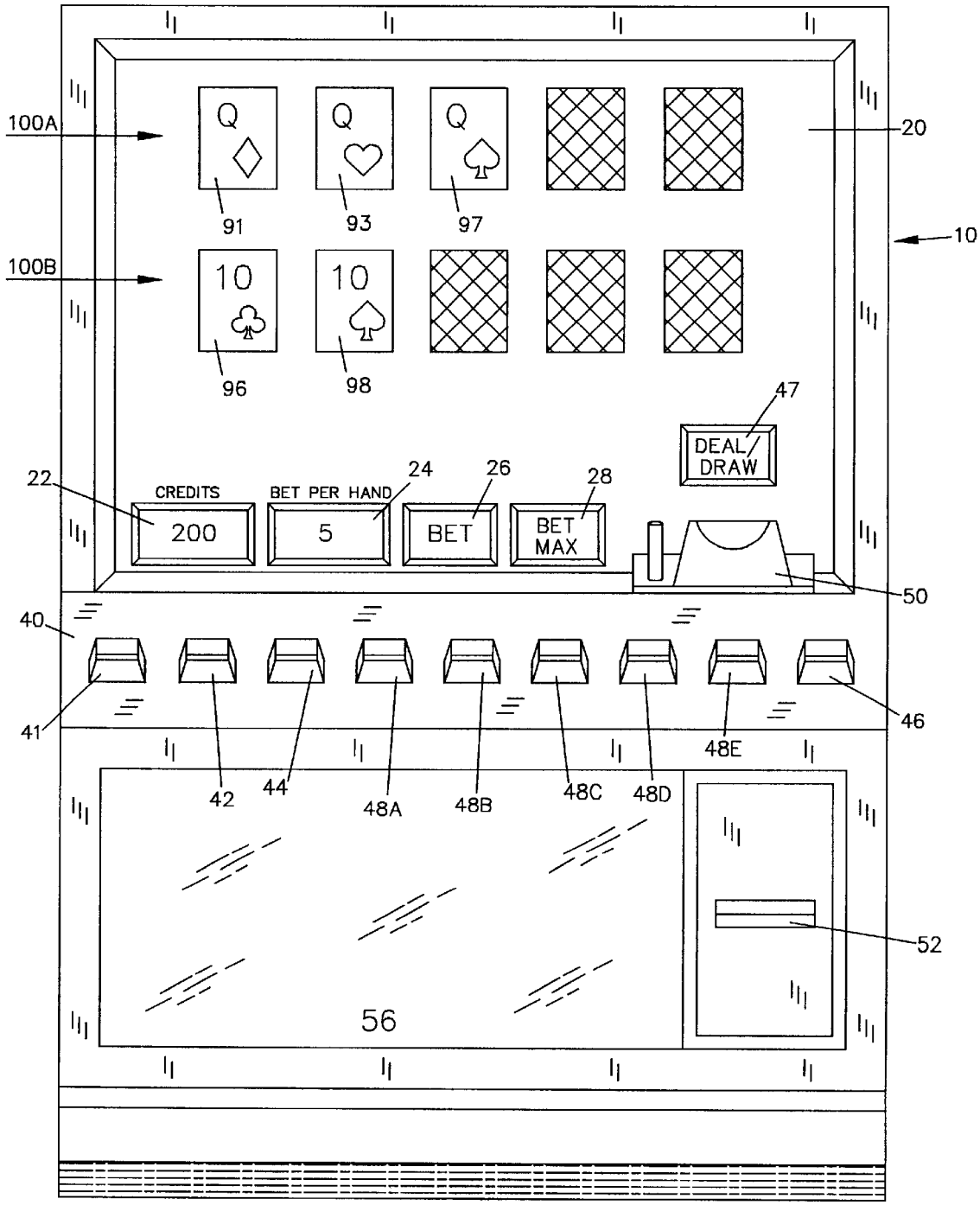
FIG. 6 shows a representative electronic video gaming machine of the present invention including a typical screen display used in the method of play of version #2 of the present invention after the player has elected to split his ending hand.

If the player presses the YES screen location 81 and does wish to split his ending hand 100, the ending hand 100 is split into two partial hands 100A and 100B as shown in FIG. 6. For example, a ending hand 100 of a Full House is split into the three Queens first hand 100A and the two Tens second hand 100B. Even though the player has only made a single wager such as five credits at the beginning of the round of play, each hand is played for a value of the amount of the player's single wager, i.e. the first hand 100A is played for a value of five credits and the second hand 100B is played for a value of five credits.

After the ending hand 100 has been split into the two hands 100A and 100B, additional cards are dealt from the original deck into each of the two hands to complete each hand to a five card final hand.

Figure 7:
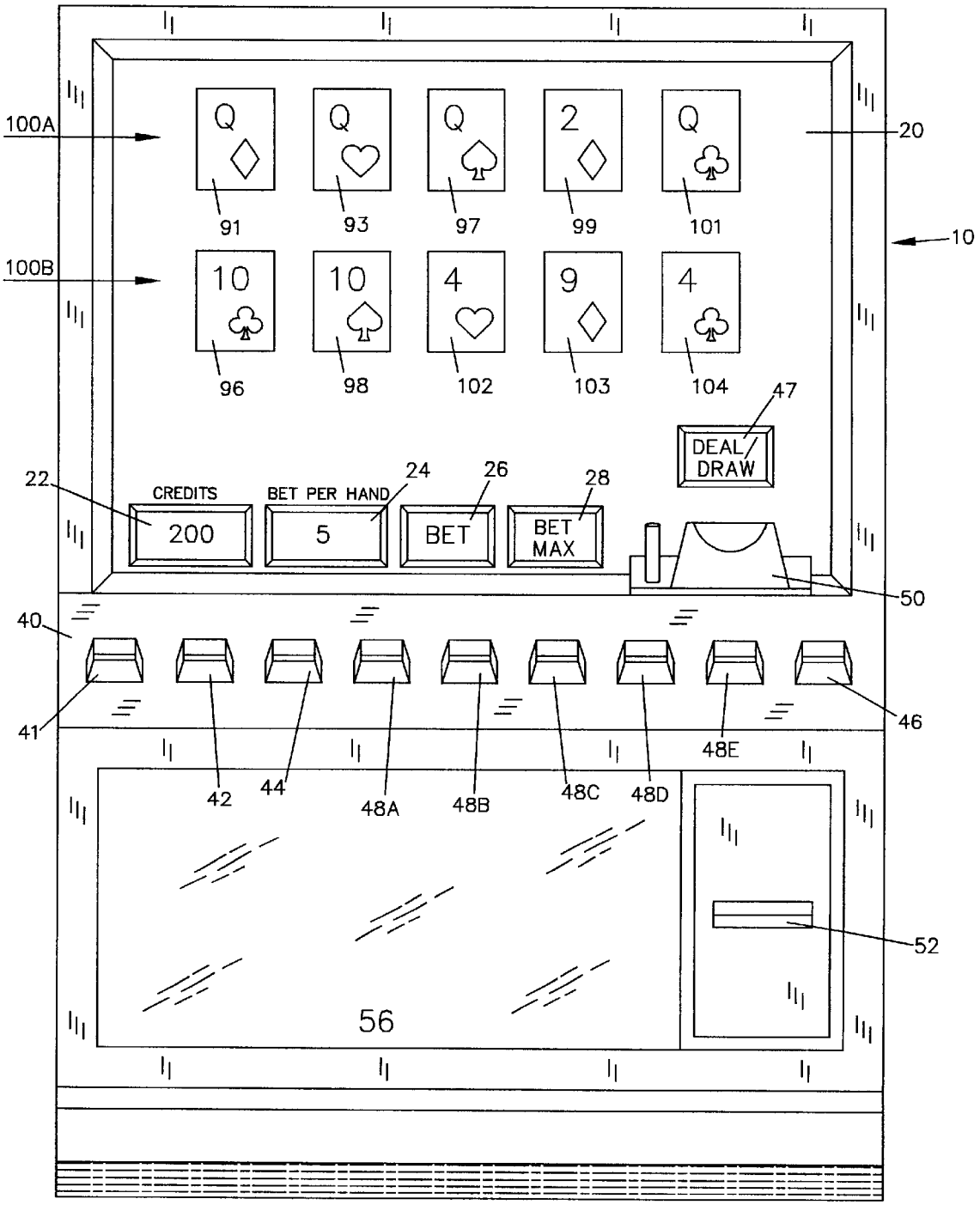
FIG. 7 shows a representative electronic video gaming machine of the present invention including a typical screen display used in the method of play of version #2 of the present invention after the additional cards have been dealt to each of the split hands.

As shown in the example in FIG. 7, first hand 100A receives two more cards—the Two of Diamonds 99 and the Queen of Clubs. The final five card first hand 100A has a poker hand ranking of a Four-of-a-Kind. Because a Four-of-a-Kind is a higher poker hand ranking than the Full House that the player had as an ending hand before the player elected to split the Full House, the final first hand 100A is a winning hand and the player is paid according to the pay table associated with this game at a value of five credits, i.e. the player would be awarded fifty credits.

Also as shown in the example in FIG. 7, second hand 100B receives three more cards—the Four of Hearts 102, the Nine of Diamonds 103 and the Four of Clubs 104. The final five card second hand 100B has a poker hand ranking of a Two Pair. Because a Two Pair is a lower poker hand ranking than the Full House that the player had as an ending hand before the player elected to split the Full House, the final second hand 100B is a losing hand and the player receives no award.

Although it is theoretically possible to allow the player to split any ending hand, in the preferred embodiment of the present invention as noted above, the player would only be allowed to split an ending hand that had a Pair of Jacks, Queens, Kings or Aces; Two Pair; a Three-of-a-Kind or a Full House.

If the ending hand is a Pair of Jacks, Queens, Kings or Aces, this hand would split into two hands—the first hand having the Pair of Jacks, Queens, Kings or Aces and the second hand having the three remaining cards. For example, an ending hand of a Pair of Jacks and three other cards (none of which are a Pair or Three-of-a-Kind) would be split into a first hand of the two Jacks and a second hand of the three remaining cards. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager. In order for the player to receive an award on any of the two final hands, a final hand would have to have a poker hand ranking greater than a Pair of Jacks, Queens, Kings or Aces.

If the ending hand is Two Pair, this hand would split into three hands—the first hand having a single pair, the second hand having a single pair and the third hand having the remaining one card. For example, a ending hand of two Sixes, two Jacks and an Ace would be split into a first hand of two Sixes, a second hand of two Jacks and a third hand of the Ace. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager. In order for the player to receive an award on any of the three final hands, a final hand would have to have a poker hand ranking greater than Two Pair.

If the ending hand is Three-of-a-Kind, this hand would split into two hands—the first hand having the Three-of-a-Kind and the second hand having the remaining two cards. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager. In order for the player to receive an award on any of the two final hands, a final hand would have to have a poker hand ranking greater than a Three-of-a-Kind.

If the ending hand is a Full House, this hand would split into two hands as shown in the example above—the first hand having a Three-of-a-Kind and the second hand having a Pair. Each hand would be completed to a five card hand by dealing additional cards from the cards remaining in the original deck of cards. Each hand would be analyzed for its poker hand ranking and winning poker hand rankings according to the associated pay table would be paid based on the value of the player's original wager. In order for the player to receive an award on any of the two final hands, a final hand would have to have a poker hand ranking greater than a Full House.

Any suitable pay table may be used and would be associated with the poker format being used by the player in this version #2. The method of play of the present invention can be played with any suitable video draw poker format such as Draw Poker, Bonus Poker, Double Bonus Poker, Double Double Bonus Poker, Triple Bonus Poker, Super Bonus Poker and the like. Each of these poker format would use a standard deck of fifty-two playing cards. It is also possible to play the method of the present invention in draw poker formats that include wild cards such as Deuces Wild, One-Eyed Jacks Wild and the like. Additional wild cards, such as one or more Jokers, may be added to the conventional fifty-two card deck to allow the method of the present invention to be played in poker formats such as Jokers Wild, Deuces Joker Wild and the like.

In any of the above-described versions of the present invention, the computer controls of the gaming machine could be configured to not allow the player an election of whether to split his hand or not. Any starting hands or ending hands, as the case may be, that is eligible to be split would be automatically split by the computer controls. The computer controls would effect such a slot whenever it is advantageous to the player according to conventional video poker strategy based on an analysis of the expected value of the hand.

While the invention has been illustrated with respect to several specific embodiments thereof, these embodiments should be considered as illustrative rather than limiting. Various modifications and additions may be made and will be apparent to those skilled in the art.

What is claimed is:

1. A method of playing a card game comprising:

a) displaying an initial hand of at least five cards all face up;

b) if the initial hand contains a predetermined arrangement of cards, allowing a player the option of splitting the initial hand into at least two partial hands;

c) if the player declines to split the initial hand, the player then selects none, one or more of the face up cards from the initial hand as cards to be held, discarding the unselected cards and displaying replacement cards for the discarded cards resulting in a first final hand and determining the poker hand ranking of the first final hand;

d) if the player accepts to split the initial hand, then splitting the initial hand into at least two partial hands in which a second partial hand comprises the predetermined arrangement of cards and a third partial hand comprises the remaining cards of the initial hand;

e) displaying additional cards in the second partial hand to form a final second hand and displaying additional cards in the third partial hand to form a final third hand; and f) determining the poker hand ranking of the resulting cards of the final second hand and the final third hand.

2. The method of claim 1 further including the steps of:

a) the player making a wager;

b) paying the player a pre-established amount based on the amount of the wager if the resulting cards of the final first hand comprise a predetermined poker hand ranking;

c) paying the player a pre-established amount based on the amount of the wager if the resulting cards of the final second hand comprise a predetermined poker hand ranking; and d) paying the player a pre-established amount based on the amount of the wager if the resulting cards of the final third hand comprise a predetermined poker hand ranking.

3. The method of claim 1 in which the predetermined arrangement of cards is selected from the group consisting of a Pair of Jacks, a Pair of Queens, a Pair of Kings, a Pair of Aces, a Three-of-a-Kind and a Full House.

4. A method of playing a card game comprising:

a) displaying an initial hand of at least five cards all face up;

b) if the initial hand contains Two Pair, allowing a player the option of splitting the initial hand into three partial hands;

c) if the player declines to split the initial hand, the player then selects none, one or more of the face up cards from the initial hand as cards to be held, discarding the unselected cards and displaying replacement cards for the discarded cards resulting in a first final hand and determining the poker hand ranking of the first final hand;

d) if the player accepts to split the initial hand, then splitting the initial hand into three partial hands in which a second partial hand comprises a first Pair, a third partial hand comprises a second Pair and a fourth partial hand comprises the remaining cards of the initial hand;

e) displaying additional cards in the second partial hand to form a final second hand, displaying additional cards in the third partial hand to form a final third hand and displaying additional cards in the fourth partial hand to form a final fourth hand; and f) determining the poker hand ranking of the resulting cards of the final second hand, the final third hand and the final fourth hand.

5. The method of claim 4 further including the steps of:

a) the player making a wager;

b) paying the player a pre-established amount based on the amount of the wager if the resulting cards of the final first hand comprise a predetermined poker hand ranking;

c) paying the player a pre-established amount based on the amount of the wager if the resulting cards of the final second hand comprise a predetermined poker hand ranking;

d) paying the player a pre-established amount based on the amount of the wager if the resulting cards of the final third hand comprise a predetermined poker hand ranking; and e) paying the player a pre-established amount based on the amount of the wager if the resulting cards of the final fourth hand comprise a predetermined poker hand ranking.

6. A method of playing a card game comprising:

a) displaying an initial hand of at least five cards all face up;

b) a player selecting none, one or more of the face up cards from the initial hand as cards to be held, discarding the unselected cards and displaying replacement cards for the discarded cards resulting in a first final hand;

c) if the first final hand contains a predetermined arrangement of cards, allowing the player the option of splitting the first final hand into at least two partial hands;

d) if the player declines to split the first final hand, determining the poker hand ranking of the first final hand;

e) if the player accepts to split the first final hand, then splitting the first final hand into at least two partial hands in which a second partial hand comprises the predetermined arrangement of cards and a third partial hand comprises the remaining cards of the first final hand;

f) displaying additional cards in the second partial hand to form a final second hand and displaying additional cards in the third partial hand to form a final third hand; and g) determining the poker hand ranking of the resulting cards of the final second hand and the final third hand.

7. The method of claim 6 further including the steps of:

a) the player making a wager;

b) paying the player a pre-established amount based on the amount of the wager if the resulting cards of the final first hand comprise a predetermined poker hand ranking;

c) paying the player a pre-established amount based on the amount of the wager if the resulting cards of the final second hand comprise a predetermined poker hand ranking; and d) paying the player a pre-established amount based on the amount of the wager if the resulting cards of the final third hand comprise a predetermined poker hand ranking.

8. The method of claim 6 in which the predetermined arrangement of cards is selected from the group consisting of a Pair of Jacks, a Pair of Queens, a Pair of Kings, a Pair of Aces, a Three-of-a-Kind and a Full House.

9. A method of playing a card game comprising:

a) displaying an initial hand of at least five cards all face up;

b) a player selecting none, one or more of the face up cards from the initial hand as cards to be held, discarding the unselected cards and displaying replacement cards for the discarded cards resulting in a first final hand;

c) if the first final hand contains a Two Pair, allowing the player the option of splitting the first final hand into three partial hands;

d) if the player declines to split the first final hand, determining the poker hand ranking of the first final hand;

e) if the player accepts to split the first final hand, then splitting the first final hand into three partial hands in which a second partial hand comprises a first Pair, the third partial hand comprises a second Pair and a fourth partial hand comprises the remaining cards of the first final hand;

f) displaying additional cards in the second partial hand to form a final second hand, displaying additional cards in the third partial hand to form a final third hand and displaying additional cards in the fourth partial hand to form a final fourth hand; and g) determining the poker hand ranking of the resulting cards of the final second hand, the final third hand and the final fourth hand.

10. The method of claim 9 further including the steps of:

a) the player making a wager;

b) paying the player a pre-established amount based on the amount of the wager if the resulting cards of the final first hand comprise a predetermined poker hand ranking;

c) paying the player a pre-established amount based on the amount of the wager if the resulting cards of the final second hand comprise a predetermined poker hand ranking;

d) paying the player a pre-established amount based on the amount of the wager if the resulting cards of the final third hand comprise a predetermined poker hand ranking; and e) paying the player a pre-established amount based on the amount of the wager if the resulting cards of the final fourth hand comprise a predetermined poker hand ranking.

* * * * *